United States Patent [19]

Srivastava et al.

[11] Patent Number: 4,935,261

[45] Date of Patent: Jun. 19, 1990

[54] METHOD FOR CONTROLLING ACCURATE DISPENSING OF ADHESIVE DROPLETS

[75] Inventors: Nilendu Srivastava; Fei-Jain Wu, both of Chelmsford; Michael J. Chalsen, Lowell; Leslie Scenna, Amherst, all of Mass.

[73] Assignee: Micro Robotics Systems Inc., Chelmsford, Mass.

[21] Appl. No.: 258,601

[22] Filed: Oct. 17, 1988

[51] Int. Cl.[5] ..... B05D 1/26

[52] U.S. Cl. ..... 427/10; 427/96; 356/379; 222/1; 222/52; 222/14; 222/61; 222/420

[58] Field of Search ..... 222/54, 56, 59, 420, 222/422, 14–20, 55, 61, 58; 118/300; 427/8, 10, 11; 364/479, 509, 510, 555; 356/372, 379, 380

[56] References Cited

U.S. PATENT DOCUMENTS

| | | | |
|---|---|---|---|
| 3,476,291 | 11/1969 | Glaser | 222/14 |
| 3,825,153 | 7/1974 | Patrick et al. | 222/14 |
| 4,030,640 | 6/1977 | Citrin et al. | 222/420 X |
| 4,041,995 | 8/1977 | Columbus | 222/420 X |
| 4,218,989 | 8/1980 | Fujita et al. | 427/8 |
| 4,458,827 | 7/1984 | Stelte | 222/14 X |
| 4,513,796 | 4/1985 | Miller et al. | 222/14 |
| 4,661,368 | 4/1987 | Rohde et al. | 427/8 |
| 4,683,143 | 7/1987 | Riley | 427/8 |

FOREIGN PATENT DOCUMENTS

| | | | |
|---|---|---|---|
| 197801 | 1/1978 | Fed. Rep. of Germany | 356/379 |

*Primary Examiner*—Kevin P. Shaver
*Assistant Examiner*—William Todd Waffner
*Attorney, Agent, or Firm*—Samuels, Gauthier, Stevens & Kehoe

[57] ABSTRACT

A method of optically controlling the volume of adhesive extruded from an orifice. A camera continuously monitors the adhesive discharged from the orifice; this adhesive is not applied to the target area until its volume is within preestablished limits. When the volume of adhesive is visually determined to be acceptable it is then applied to the target area. The camera is used again, to confirm the proper amount of adhesive has been applied to the target area by measuring the volume of adhesive remaining on the orifice after contacting the target area.

7 Claims, 5 Drawing Sheets

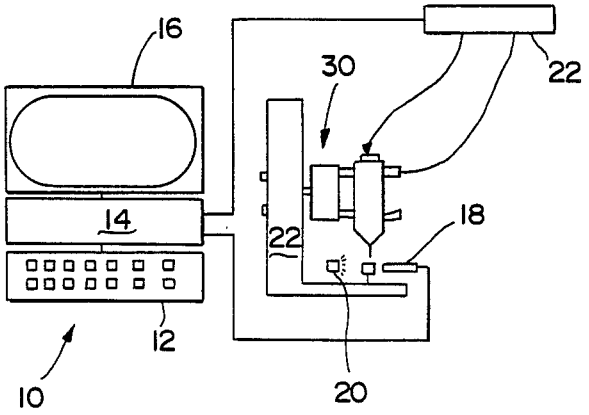
FIG. 1
FIG. 4
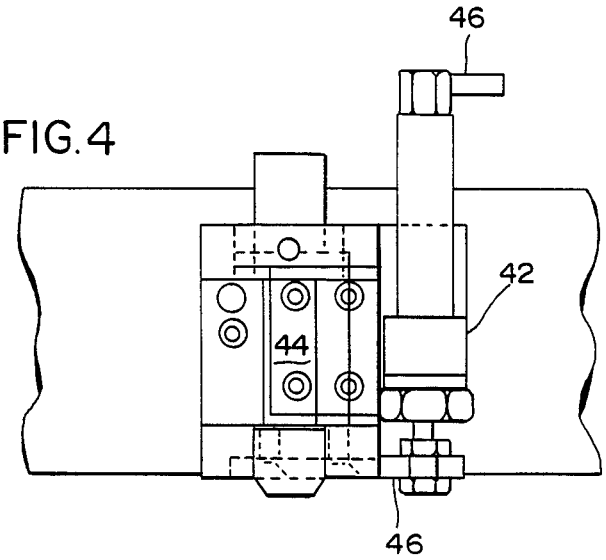

METHOD FOR CONTROLLING ACCURATE DISPENSING OF ADHESIVE DROPLETS

BACKGROUND AND BRIEF SUMMARY OF THE INVENTION

The invention relates to a dispensing system for depositing discrete amounts of adhesives on a surface. More particularly, the system monitors and controls the amount of adhesive deposited on a surface to which a microcomponent is secured.

In electronics many assembled parts are exceedingly small such that vision systems are necessary to view the movement, placement and securing of the parts one to the other. Securing of the parts usually includes bonding by solder or adhesives. In some applications, the parts are pretreated by coating with a solder or adhesive, engaging the parts and then being cured by heat. These bonding techniques are suitable for components that once assembled remain static except possibly for the flow of electrons. In some applications the assemblies are subjected to varying mechanical stresses during curing process. In this environment, a thin film coating of adhesive is usually not sufficient. One such component that is subject to stress is a read-write slide which is secured to a supporting resilient arm. In a typical application, one end of the supporting arm is fastened to a base. The other end or the arm supports the read-write slide. The head is joined to the other end of the arm by adhesive, usually a drop of epoxy adhesive.

Epoxy dispensing systems for joining a read-write slide to a supporting arm are currently in use. The average deposit of epoxy on the arm will vary between 2 to $8\times10^{-6}$ cubic inches. Typically, the deposits are discharged through an orifice in timed sequence or manually.

The amount to be deposited is initially calibrated. Once a dispensing system is calibrated, the viscosity and rheology of the adhesive may change with temperature and with time. Also the homogenity of the adhesive is not always uniform. The adhesive may include dissolved gases. However, with the small amounts involved, slight temperature changes will affect the physical properties of the adhesive. If the deposit becomes too small, an incomplete bonding results. If the deposit becomes too great, the bond may be sufficient but because of the size and delicate nature of the assembly, the excess adhesive can interfere with the proper functioning of the assembly. Therefore, dispensing systems which depend upon a fixed pulsed displacement of adhesive by the precalibrated movement of a piston or the like are subject to variations in the amounts of adhesive dispensed.

Our invention overcomes these problems of variations in the amounts of deposited adhesive by optically controlling the amount of adhesive dispensed from an orifice. The adhesive is discharged through an orifice but does not contact a target surface. The amount of adhesive depending from the orifice is continuously monitored by a vision system. When the amount or size of adhesive depending from the orifice is within pre-established limits, the adhesive is then transferred to the target surface.

In a preferred embodiment, a camera system views the amount of the adhesive extruded from the orifice. Based on this information, the adhesive stops flowing or continues to flow through the orifice until the proper amount is reached. At this time, the flow ceases and some of the adhesive is transferred. The amount of adhesive which remains depending from the orifice after transfer is measured to ensure the correct amount was transferred. Therefore, our invention overcomes the problems inherent with those systems where the adhesive is subject to variations in viscosity and homogenity.

Our invention, in a preferred embodiment, comprises flowing an adhesive through an orifice, measuring the amount of adhesive being extruded from the orifice, stopping the flow of adhesive through the orifice when a predetermined amount of adhesive has been extruded and transferring the adhesive to a target site, measuring the amount of adhesive remaining on the orifice after transfer and confirming the amount transferred was within pre-established limits.

BRIEF DESCRIPTION OF THE DRAWINGS

FIG. 1 is a block diagram of a dispensing system embodying the invention;

FIG. 4 is a right side view of the dispenser of FIG. 2;

DESCRIPTION OF THE PREFERRED EMBODIMENT

Figure 2:
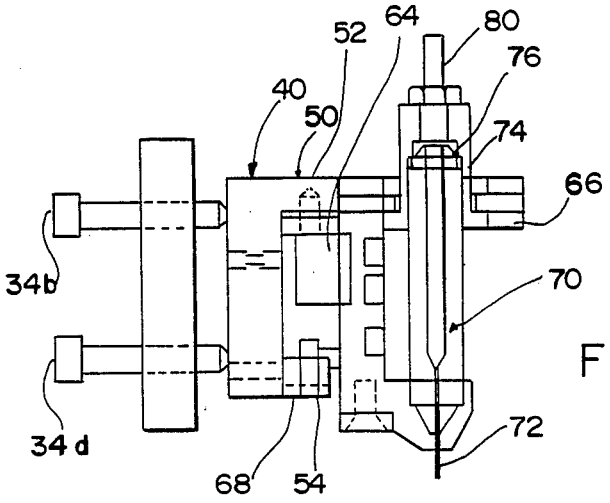
FIG. 2 is a front view of the dispenser.

Our invention will be described in reference to a stand alone adhesive dispensing system which is easily integrated into existing systems for the automatic manipulation of microcomponents. Further, the invention will be described with particular reference to applying discrete amounts of adhesive to the arm of a read-write slide. The acquisition of the arm, its movement to an assembly station where the adhesive is applied, its removal from the assembly station, and the subsequent engagement of the read-write slide to the adhesive on the arm are all steps within the skill of the art and need not be described in detail.

The dispensing system 10 is shown generally in FIG. 1 and comprises a computer console 10 which includes a keyboard 12, a terminal 14 and a video display 16; a vision system with a camera 18 and an illumination source 20; a dispenser 30 and a pneumatic power source 22.

Figure 3:
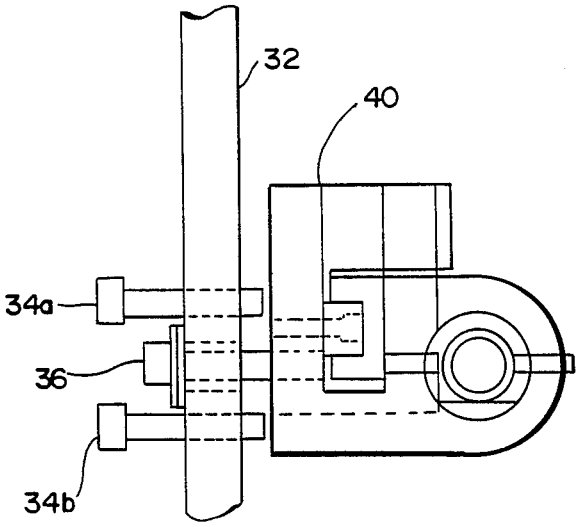
FIG. 3 is a plan view of the dispenser of FIG. 2.

Referring to FIGS. 2, 3 and 4, the dispenser 30 is shown in greater detail and comprises a mounting plate 32 through which passes four alignment screws, three shown 34*a*–34*c*, and a fastening screw 36. Secured to the plate 32 by the screw 36 is a bracket 40. The bracket 40 includes a double acting pneumatic cylinder 42 which drives a linkage plate 44. The linkage plate 44 drives a needle assembly. The cylinder includes a pneumatic line 46 and is secured to the bracket 40 by a lower plate 48. An upper plate 50 is parallel to the plate 48. Each of the-plates 48 and 50 carry limit screws 52 and 54 respectively.

Figure 7:
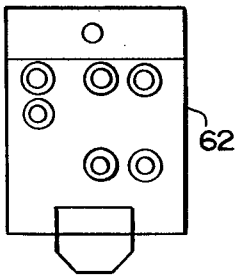
FIG. 7 is a right side view of FIG. 5.
Figure 6:
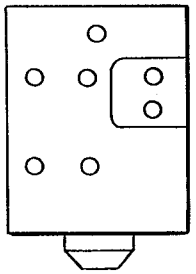
FIG. 6 is a left side view of FIG. 5.
Figure 5:
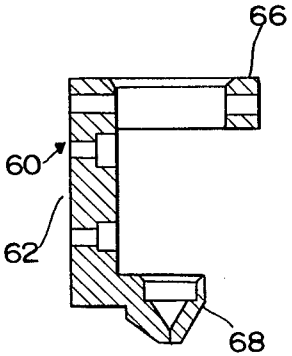
FIG. 5 is a front view of the needle holder assembly.

Referring to FIGS. 6, 7 and 8, the needle assembly comprises a needle holder 60 which has a wall 62 joined to the linkage plate 44. Secured to the wall 62 is a stop member 64 which travels between the limit screws 52 and 54.

Referring to FIG. 2, the holder 60 includes an upper arm 66 and a lower arm 68. A cylindrical shaped needle body 70 is received in the lower arm 68 and passes through the upper arm 66. A dispensing needle 72 is carried in the body 70. A cap 74 is secured to the upper arm 66 sealingly engaging and enclosing the upper end of the needle 72 and the body 70 and defining a chamber 76. An O-ring 78 ensures a fluid tight seal between the cap 74 and the body 70. A pneumatic line 80 is joined to the cap 74.

The area of measurement of adhesive is therefore viewed from one side although multiple cameras may be used. The input from the camera 18 is processed in the terminal 14 and displayed on the screen 16.

In the operation of the invention the dispenser 30 is first calibrated. Adhesive is placed in the needle 72. Discrete droplets are extruded from the needle until the predetermined amount is reached, the amount of droplet is measured, the needle is moved down to transfer the adhesive to the target site the needle is withdrawn to its original position. A measurement is taken of the residue left over on the needle. (The amount of adhesive deposited on the target site may also be viewed, if the nature of the application allows to do so). By calculating the difference of the amount of epoxy before and after the dispensing, the actual amount dispensed can be computed and compared to the target amount.

The viewing of an object with a camera to determine its size and/or volume, the display of the viewed object and the comparison of the viewed object to pre-established limits are well-established techniques. The application of these techniques for this invention have not heretofore been known.

Referring to FIGS. 8*a* through 8*g*, the tip 82 of the needle 72 is shown with adhesive 84 depending therefrom (FIG. 8*a*) from a previous application. A target site 86 to which the adhesive is to be transferred is directly below.

Figure 8A:
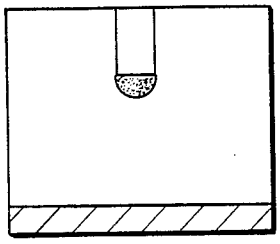
FIGS. 8*a* through 8*g* are illustrations of the transfer of adhesive.
Figure 8B:
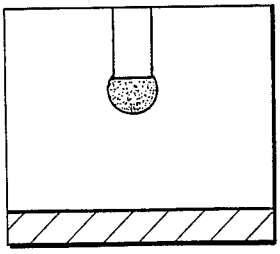
Figure 8C:
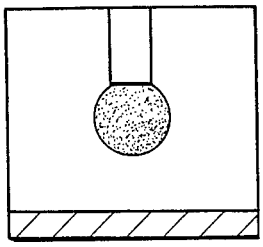
Figure 8D:
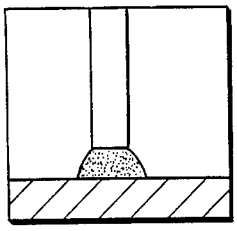

The air pressure through line 80 functions as the driving force for the movement of the epoxy through the needle. The camera 18 continuously measures the amount of epoxy being extruded from the end of the needle. The pressure stops when the precalibrated amount is reached FIG. 8*c*. Actuation of the cylinder 42 moves the needle with the dispensing adhesive a predetermined distance into engagement with the target site. FIG. 8*d*: Epoxy is in contact with the target surface.

Figure 8E:
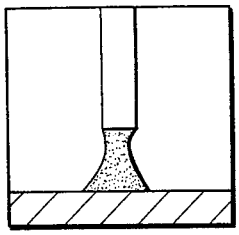
Figure 8F:
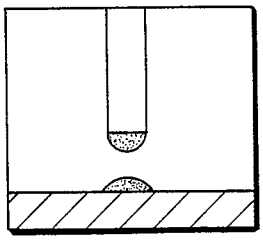
Figure 8G:
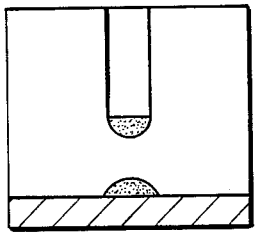

The tip is retracted to its initial position by the cylinder 42. In the process of retracting, part of the epoxy pulls down due to the nature (viscosity) of the epoxy. FIG. 8*e*. The needle retracts to its initial position, FIG. 8*f*, by reversing the cylinder 42. At this time, the amount of epoxy left over on the tip is measured by the vision system and compared to the amount from FIG. 8*c*. Based on this information, it is determined if sufficient adhesive has been transferred to the arm.

Having described our invention, what we now claim is:

1. A method for controlling the amounts of adhesive deposited on micro components which includes:
   extruding an adhesive through an orifice;
   measuring visually the volume of adhesive extruded from the orifice;
   stopping the flow of adhesive through the orifice when a predetermined volume of adhesive has been extruded;
   transferring the adhesive to a target site;
   measuring visually the volume of adhesive transferred; and
   confirming the volume transferred was within preestablished limits.

2. The method of claim 1 wherein the confirming of volume transferred was within preestablished limits includes:
   measuring visually the volume of adhesive remaining on the orifice after the transfer has been made; and
   comparing said remaining volume to the amount of adhesive extruded from the orifice prior to transfer to the target site.

3. The method of claims 1 or 2 wherein the adhesive is an epoxy adhesive.

4. The method of claim 1 wherein the target sight comprises a read-wright slide.

5. The method of claims 1 or 2 which includes: a camera system for measuring visibly the volume of adhesive.

6. The method of claims 1 or 2 wherein the adhesive is extruded by pneumatic pressure.

7. The method of claims 1 or 2 wherein the adhesive is extruded and transferred along a vertical axis and which includes:
   measuring along a horizontal axis.

* * * * *